US005609787A

United States Patent [19]

Abe et al.

[11] Patent Number: 5,609,787

[45] Date of Patent: Mar. 11, 1997

[54] METHOD FOR EXTINGUISHING FIRE

[75] Inventors: Takashi Abe, Kasugai; Haruhiko Fukaya, Oobu; Eiji Hayashi, Konan; Yoshio Hayakawa, Kita-ku, all of Japan

[73] Assignee: Agency of Industrial Science & Technology, Ministry of International Trade & Industry, Tokyo, Japan

[21] Appl. No.: 341,068

[22] Filed: Nov. 17, 1994

[30] Foreign Application Priority Data

Nov. 18, 1993 [JP] Japan ..... 5-312624

[51] Int. Cl.[6] ..... A62D 1/02; A62D 1/00

[52] U.S. Cl. ..... 252/3; 252/2; 252/8; 169/46

[58] Field of Search ..... 252/2, 8, 3; 169/46, 169/47

[56] References Cited

U.S. PATENT DOCUMENTS

| | | | |
|---|---|---|---|
| 5,210,106 | 5/1993 | Dams et al. | 521/110 |
| 5,433,880 | 7/1995 | Minor et al. | 252/67 |
| 5,441,659 | 8/1995 | Minor | 252/67 |
| 5,484,546 | 1/1996 | Minor et al. | 252/67 |
| 5,486,275 | 1/1996 | Fukaya et al. | 204/157.6 |

OTHER PUBLICATIONS

Chemical Abstract, vol. 123, No. 12852, (1994), Takahashi et al., "Inhibition of Combustion by bromine–free Polyfluorocarbons"; Taken from the Journal entitled Combustion Science Technology vol. 102(1–6), pp. 213–230, published on Apr. 26th 1994.

Synthesis and Evaluation of Perfluoroalkylamines as Halon Alternatives. Journal of Environmental Chemistry, vol. 3, No. 2, pp. 271–277, 1993. Haruhiko Fukaya, et al.

*Primary Examiner*—Sharon Gibson
*Assistant Examiner*—Joseph D. Anthony
*Attorney, Agent, or Firm*—Oblon, Spivak, McClelland, Maier & Neustadt, P.C.

[57] ABSTRACT

A method for extinguishing fire uses a gaseous fire-extinguishing agent having as an active component thereof a polyfluoro-tertiary amine represented by the following formula:

$$(CF_3)_2NRf$$

wherein Rf stands for a polyfluoroalkyl group of 1–4 carbon atoms or a polyfluoroalkenyl group of 1–4 carbon atoms.

1 Claim, No Drawings

METHOD FOR EXTINGUISHING FIRE

BACKGROUND OF THE INVENTION

1. Field of the Invention

This invention relates to a method for extinguishing a fire, characterized by using a polyfluoro-tertiary amine as the main component of a gaseous fire-extinguishing chemical agent. Use of the currently employed gaseous halon fire-extinguishing chemical agent has been restricted because of its tendency to deplete the stratospheric ozone. The present invention concerns a method for efficiently extinguishing fire by using a fire-extinguishing chemical agent having as a main component thereof a polyfluoro-tertiary amine, a compound assuming a gaseous state at room temperature or assuming a liquid state at room temperature but having a low boiling point, in the place of the aforementioned gaseous halon fire-extinguishing chemical agent.

2. Description of the Prior Art

Recently, the use of chlorofluorocarbons (CFCs) and halons have been banned under Montreal Protocol on Substances that deplete the stratospheric ozone layer in view of the importance of preserving it. At present, CFCs are extensively used as refrigerants, solvents, and the like. As alternatives to CFCs, there have been proposed hydrofluorocarbons (HFCs) and hydrochlorofluorocarbons (HCFCs) imparted with high enough decomposability to prevent them from reaching the stratosphere by the introduction of a hydrogen atom into the fluorine compound.

As gaseous fire-extinguishing chemical agents, halon 1301 (chemical formula: $CF_3Br$), halon 1211 ($CF_2BrCl$), and halon 2402 ($CF_2BrCF_2Br$), which contain a bromine atom effective in extinguishing fire, have been in use to date. Since bromine atoms also destroy the stratospheric ozone, the gaseous fire-extinguishing chemical agents of the halon series are, like the agents of CFCs, fated to be abolished.

Recent years have seen the development of various alternatives to the halons. Compared with the halons, however, these new agents are notably deficient in the ability to extinguish fire as well as in biological safety. In such places as airplane cabins, computer rooms, and control towers where high fire extinguishing capability is required, there is still no alternative to halon.

In view of the vital importance of protecting the stratospheric ozone, a strong need has arisen for the development of an alternative fire-extinguishing chemical agent which is comparable to halon in terms of fire extinguishing ability, biological safety and compatibility with other substances but which does not destroy the stratospheric ozone.

SUMMARY OF THE INVENTION

The present inventors continued a study with a view to meeting this need. This invention was accomplished as a result.

To be specific, the present invention resides in a method for the extinguishing of fire with a gaseous fire-extinguishing agent which has as an active component thereof a polyfluoro-tertiary amine represented by the formula:

$$(CF_3)_2NRf$$

wherein Rf stands for a polyfluoroalkyl group of 1–4 carbon atoms or a polyfluoroalkenyl group of 1–4 carbon atoms.

DESCRIPTION OF THE PREFERRED EMBODIMENTS

The polyfluoro-tertiary amines are thermally and chemically stable compounds and are generally synthesized by electrolytic fluorination of corresponding amines. When the polyfluoro-tertiary amines and perfluorohydrocarbons are compared in terms of chemical reactivity, it is found that the former compounds, owing to the nitrogen atom contained therein, exhibit reactivity even under such conditions as prevent the latter compounds from reacting. We believe therefore, that the polyfluoro-tertiary amines are more readily decomposable than the perfluorohydrocarbons.

The inventors conducted a further study regarding the chemical characteristics of polyfluoroamines. As a result, they ascertained (a) that the aforesaid polyfluoro-tertiary amines are themselves excellent alternative fire extinguishing agents to halon since when heated they produce a $CF_3$ radical with strong fire-extinguishing capability, since the presence of a nitrogen atom in their molecular structure gives them a shorter lifetime in the atmosphere than perfluorohydrocarbons and since they do not contain a bromine atom which deplete ozone layer and (b) that, in addition to their own excellent fire-extinguishing performance, their low surface energy enables them to produce such synergistic effects as anti-agglomeration activity when added in a small amount to powder fire-extinguishing chemical agents (main component: Ammonium phosphate).

Compounds containing 5 or more carbon atoms in the Rf of the formula $(CF_3)_2NRf$ are not suitable as a fire-extinguishing agent because such compound have a considerable high boiling point.

This invention pertains to a method for extinguishing fires. From the chemical point of view, this method comprises spraying a polyfluoro-tertiary amine of this invention on a substance in the process of flaming combustion thereby stopping the combustion.

This invention will now be described more specifically below with reference to working examples. It should be noted, however, that the present invention is in no way limited by these examples.

EXAMPLE 1 AND COMPARATIVE EXAMPLE 1

A fire extinguishing capability test (method A) was carried out with a test box (made of polyacrylic resin) measuring 20 cm×20 cm×20 cm. The test box was provided in the upper part thereof with a small window for introduction of a fire-extinguishing chemical agent and in the side panel near the bottom thereof with a small window for introduction of air. First, 3 ml of n-heptane was placed in a metallic petri dish (5 cm in diameter ×1 cm in depth) disposed in the text box and ignited. The n-heptane was allowed to burn for 7 seconds (preliminary combustion). During the preliminary combustion, the small window for introduction of air was kept open to allow ample growth of the flame. At the same time when a gaseous fire-extinguishing chemical agent prepared beforehand by mixing a given fire-extinguishing agent with air was introduced into the test box, the small window was closed. The time required for the introduced agent to thoroughly extinguish the fire was clocked and recorded. The results of this test performed with perfluoro(N,N-dimethylethylamine), N,N-bistrifluoromethyl-1,1,2,2-tetrafluoroethylamine, perfluoro(N,N-dimethylvinylamine), perfluoro(trimethylamine), and bromotrifluoromethane (halon 1301) are shown in Table 1.

TABLE 1

| Fire-extinguishing agent | (Vol %) | Time required (sec) |
|---|---|---|
| Example | | |
| $(CF_3)_2NCF_2CF_3$ | 5.7 | 1.50 |
| | 3.8 | 0.82 |
| | 2.6 | 7.00 |
| $(CF_3)_2NCF_2CF_2H$ | 5.4 | 1.50 |
| $(CF_3)_2NCF{=}CF_2$ | 3.6 | 0.86 |
| | 2.8 | 7.70 |
| $(CF_3)_3N$ | 5.5 | 1.67 |
| | 3.6 | 4.36 |
| Comparative Example | | |
| $CF_3Br$ (halon 1301) | 3.6 | 1.01 |
| | 1.1 | 10.04 |

It is clear from Table 1 that the polyfluoroamines, when used at rates in the range of from about 3 to about 5 vol %, extinguished the fire within two seconds, namely as quickly as halon 1301. The data demonstrate the ideal fire-extinguishing ability of these polyfluoroamines.

EXAMPLE 2 AND COMPARATIVE EXAMPLE 2

A second test of fire-extinguishing ability (method B) was carried out by measuring the laminar flame speed. A cylindrical combustion vessel 20.0 cm in inside diameter and 30.0 cm in height was used for the determination of the laminar flame speed. The vessel was filled with a mixed gas prepared beforehand (composed of 9.5% of methane, 0.5% of additive, and 90.0% of air and held at normal room temperature under a pressure of 1 atmosphere) and the mixed gas was ignited with a spark generated at the center of the vessel. The rate of propagation of the flame was measured by the use of ion probes. Since the flame propagated under a virtually fixed pressure during the initial state of combustion, the relation between the laminar flame speed, Su, and the rate of flame propagation, Sb, could be expressed by the formula:

$$Su=\kappa Sb(\rho b/\rho u)=\kappa Sb(TuMb)/(TbMu)$$

wherein ρ stands for density, T for temperature, M for average molar mass, κ for coefficient of correction, u for the side awaiting combustion, and b for the side having undergone combustion.

The magnitude of Su was calculated by using the adiabatic fire temperature for Tb and the numerical value obtained from the equilibrium concentration of given chemical agents for Mb on the assumption of κ=1. The rates of average laminar flame speed of methane in the presence of tetrafluoromethane, bromotrifluoromethane (halon 1301), perfluoro(N,N-dimethylethylamine), perfluoro(N,N-dimethyl-2-bromoethylamine), and perfluoro(triethylamine) are sown in Table 2.

TABLE 2

| Additive | Rate of laminar-flow combustion/cm · $s^{-1}$ |
|---|---|
| Comparative Example | |
| $CF_4$ | 37.2 ± 1.7 |
| $CF_3Br$ (halon 1301) | 22.9 ± 1.0 |
| $(CF_3)_2NCF_2CF_2Br$ | 24.4 ± 1.0 |
| $(C_2F_5)_3N$ | 27.9 ± 1.0 |
| Example | |
| $(CF_3)_2NCF_2CF_3$ | 26.0 ± 1.0 |

From the results of Table 2, it is clear that the perfluoro(N,N-dimethylethylamine) which is a compound according to this invention possesses an excellent fire-extinguishing ability surpassed only by halon 1301 and perfluoro(N,N-dimethyl-2-bromoethylamine) which both contain a bromine atom.

What is claimed is:

1. A method for extinguishing fire comprising applying to the fire a gaseous fire extinguishing composition comprising, as an active component, a polyfluoro-tertiary amine represented by the formula:

$$(CF_3)_2NRf$$

wherein Rf is a polyfluoroalkenyl group of 2–4 carbon atoms.

* * * * *